US010406571B2

(12) United States Patent
Innes et al.

(10) Patent No.: US 10,406,571 B2
(45) Date of Patent: Sep. 10, 2019

(54) MECHANICAL EXTENDED REACH SLUICER

(71) Applicant: Alexander G. Innes, Stockton, CA (US)

(72) Inventors: Alexander G. Innes, Stockton, CA (US); Christopher J. Wheeler, Stockton, CA (US)

(73) Assignee: Alexander G. Innes, Stockton, CA (US)

( * ) Notice: Subject to any disclaimer, the term of this patent is extended or adjusted under 35 U.S.C. 154(b) by 152 days.

(21) Appl. No.: 15/450,187

(22) Filed: Mar. 6, 2017

(65) Prior Publication Data

US 2017/0259309 A1 Sep. 14, 2017

Related U.S. Application Data

(60) Provisional application No. 62/305,233, filed on Mar. 8, 2016.

(51) Int. Cl.
*B08B 9/093* (2006.01)
*B05B 13/04* (2006.01)
(Continued)

(52) U.S. Cl.
CPC ..... *B08B 9/0933* (2013.01); *B05B 13/0431* (2013.01); *B05B 13/0636* (2013.01);
(Continued)

(58) Field of Classification Search
CPC ... B05B 9/0933; B05B 9/093; B05B 13/0431; B05B 13/0636; B05B 13/069; B05B 15/68
(Continued)

(56) References Cited

U.S. PATENT DOCUMENTS 326,336 A 9/1885 Sandberg
1,611,326 A 12/1926 Abbe
(Continued)

FOREIGN PATENT DOCUMENTS

EP 1166903 1/2002

OTHER PUBLICATIONS

RITCHIESpecs, Gradall 534D-9-45 Telescopic Forklift, 2017, retrieved from www.ritchiespecs.com, 2 pages.
(Continued)

*Primary Examiner* — Christopher S Kim
(74) *Attorney, Agent, or Firm* — Brian S. Steinberger; Hilary F. Steinberger; Law Offices of Brian S. Steinberger, P.A.

(57) ABSTRACT

Extended reach sluicer systems, devices, and methods for breaking up and retrieving chemical, radioactive, hazardous materials and/or other waste from storage tanks, with mechanical arms and nozzles which utilize fluid jets to break up and liquefy in-tank material. The invention can work with tanks having additional issues, such as but not limited to high temperature or low temperature conditions. An upper assembly attachable to a tank can control the transverse rotation of a vertical mast and with a lower end pivotally attached to a boom having a nozzle assembly attached to an outer end. The boom can telescopically retract and extend to different length positions by cables and pulleys. Controls with take-up mechanisms can elevate up and down or transverse left and right the nozzle assembly.

1 Claim, 15 Drawing Sheets

(51) Int. Cl.
*B05B 13/06* (2006.01)
*B05B 15/68* (2018.01)

(52) U.S. Cl.
CPC ..... *B08B 9/093* (2013.01); *B05B 13/069* (2013.01); *B05B 15/68* (2018.02)

(58) Field of Classification Search
USPC ..... 239/159, 164, 165, 166, 195, 197, 198, 239/275, 279, 280–281, 587.2, 587.5
See application file for complete search history.

(56) References Cited

U.S. PATENT DOCUMENTS

| | | | | |
|---|---|---|---|---|
| 2,461,433 | A | 2/1949 | Moulton | |
| 2,668,625 | A | 2/1954 | Garland | |
| 2,761,297 | A | 9/1956 | Buchsteiner | |
| 2,819,803 | A | 1/1958 | Obenchain | |
| 2,833,422 | A | 5/1958 | Ferwerda | |
| 2,999,600 | A | 9/1961 | Gates | |
| 3,060,972 | A | 10/1962 | Sheldon | |
| 3,116,021 | A * | 12/1963 | Born | C02F 3/203 141/388 |
| 3,162,214 | A | 12/1964 | Bazinet | |
| 3,190,286 | A | 6/1965 | Stokes | |
| 3,266,059 | A | 8/1966 | Stelle | |
| 3,274,850 | A | 9/1966 | Tascio | |
| 3,305,220 | A | 2/1967 | Nevulis | |
| 3,469,712 | A | 9/1969 | Haulotte | |
| 3,497,083 | A | 2/1970 | Anderson | |
| 3,580,099 | A | 5/1971 | Mosher | |
| 3,599,871 | A | 8/1971 | Ruppel | |
| 3,845,596 | A | 11/1974 | Veenstra | |
| 3,889,818 | A | 6/1975 | Wennerstrom | |
| 4,132,041 | A | 1/1979 | Van Den Broek | |
| 4,156,331 | A | 5/1979 | Lester | |
| 4,393,728 | A | 7/1983 | Larson | |
| 4,396,093 | A | 8/1983 | Zimmerman | |
| 4,494,417 | A | 1/1985 | Larson | |
| 4,630,741 | A | 12/1986 | Stevens | |
| 4,661,039 | A | 4/1987 | Brenholt | |
| 4,685,349 | A | 8/1987 | Wada | |
| 4,848,179 | A | 7/1989 | Ubhayakar | |
| 4,944,535 | A | 7/1990 | Maupin | |
| 4,977,790 | A | 12/1990 | Nishi | |
| 5,172,710 | A | 12/1992 | Harrington | |
| 5,174,168 | A | 12/1992 | Takagi | |
| 5,297,443 | A | 3/1994 | Wentz | |
| 5,515,654 | A | 5/1996 | Anderson | |
| 5,715,852 | A | 2/1998 | Jepsen | |
| 5,740,821 | A | 4/1998 | Arnold | |
| 6,561,368 | B1 | 5/2003 | Sturm | |
| 6,889,920 | B2 | 5/2005 | Nance | |
| 7,021,675 | B2 | 4/2006 | Lawson | |
| 8,069,747 | B2 | 12/2011 | Buckingham | |
| 8,205,522 | B2 | 6/2012 | Buckingham | |
| 8,347,563 | B2 | 1/2013 | Anderson | |
| 8,414,246 | B2 | 4/2013 | Tobey | |
| 8,840,087 | B2 | 9/2014 | Guyard | |
| 2010/0234988 | A1 | 9/2010 | Buckingham | |
| 2011/0186657 | A1 | 8/2011 | Haviland | |

OTHER PUBLICATIONS

Boom, Gradall Material Handler 534 D-6/534 D-6 Turbo, Jul. 2002, 1 page.
Manitowoc, National Crane 600H Series Product Guide, 2012, 16 pages.
Manitowoc, National Crane 680H-TM, Aug. 2015, 4 pages.
Festo, Bionic Handling Assistant, Apr. 2012, 6 pages.
Schutz, Maxon Motor, Robotic Snake-Arm Flies into Tight Spaces, 2012, 4 pages.
McMahan, W., et al., Field Trials and Testing of the OctArm Continuum Manipulator, IEEE, May 2006, pp. 2336-2341, 6 pages.
Li, Z., et al., A Novel Tele-Operated Flexible Robot Targeted for Minimally Invasive Robotic Surgery, Engineering Research Robotics Article, Mar. 2015, pp. 073-078, vol. 1, issue 1, 6 pages.
Li, Z., et al., Kinematic Comparison of Surgical Tendon-Driven Manipulators and Concentric Tube Manipulators, Mechanism and Machine Theory, 2017, pp. 148-165, vol. 107, 18 pages.
Military Elevation Solutions and Tactical Trailers, KVL and KVR Telescopic Cable-Drive Masts, Sep. 2016, p. 10, 3 pages.
OCRobotics, Laser Snake 2, Snake-arm robot and high-power laser integration, www.ocrobotics.com, 2016, 4 pages.
OCRobotics, Nuclear decommissioning case study: Laser Snake, Snake-arm robot and high-power laser integration, www.ocrobotics.com, 2016, 4 pages.
Bauer, et al., Development and Deployment of the Extended Reach Sluicing System (ERSS) for Retrieval of Hanford Single Shell Tank Waste—14206 (Draft), U.S. Department of Energy, Assistant Secretary for Environmental Management, Washington River Protection Solutions, Nov. 2013, 19 pages.

* cited by examiner

REAR VIEW LEFT SIDE VIEW FRONT VIEW

RIGHT SIDE VIEW

TOP VIEW

BOTTOM VIEW

BOOM ELEVATION
DETAIL VIEW

LEFT SIDE
VIEW

REAR VIEW

ELBOW PULLEYS DETAIL VIEW

NOZZLE ASSEMBLY
DETAIL VIEW

LEFT SIDE
VIEW

TOP VIEW

LEFT SIDE VIEW BOOM EXTENDED

TOP
VIEW
BOOM EXTENDED

TELESCOPIC BOOM
DETAIL VIEW
EXTEND CABLE

TELESCOPIC BOOM
DETAIL VIEW
DIRECT RETRACT CABLE

TELESCOPIC BOOM
DETAIL VIEW
INTERCONNECTED RETRACT CABLE

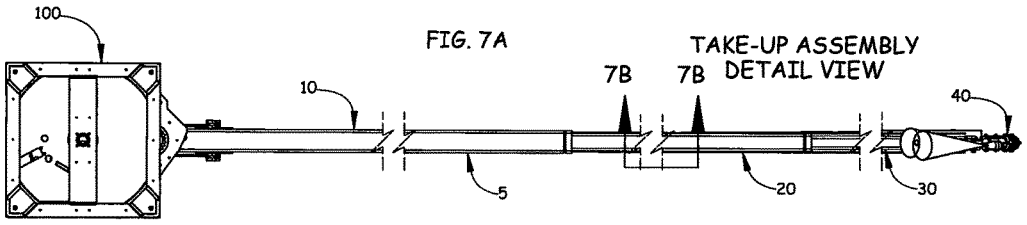
FIG. 7A
TAKE-UP ASSEMBLY DETAIL VIEW
TOP VIEW BOOM EXTENDED
FIG. 7B
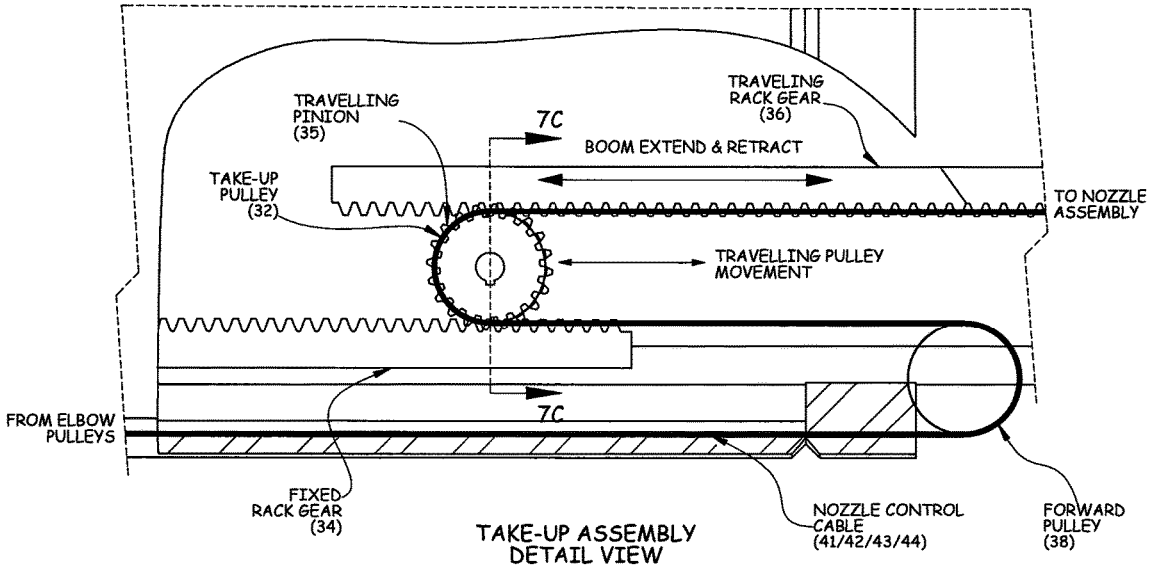
TAKE-UP ASSEMBLY DETAIL VIEW

TAKE-UP PULLEY
DETAIL VIEW

STORAGE TANK CROSS
SECTION VIEW

TOP
VIEW
BOOM EXTENDED

TELESCOPIC PROCESS
TUBING
DETAIL VIEW

TOP
VIEW
BOOM EXTENDED
SWIVEL END

DETAILED VIEW
SWIVEL END

TOP
VIEW
BOOM EXTENDED
PIVOTING NOZZLE END

DETAIL VIEW
PIVOTING NOZZLE END

MECHANICAL EXTENDED REACH SLUICER

This application claims the benefit of priority to U.S. Provisional Patent Application Ser. No. 62/305,233 filed Mar. 8, 2016, which is incorporated by reference in its' entirety.

FIELD OF INVENTION

This invention relates to breaking up and retrieving chemical, radioactive, hazardous and/or other waste and/or material from storage tanks, and in particular to extended reach sluicer systems, devices, and methods for breaking up and retrieving chemical, radioactive, hazardous materials and/or other waste and/or other material from storage tanks with mechanical arms and nozzles which utilize fluid jets to break up and liquefy tank material. The invention can work with tanks having high temperature or low temperature conditions.

BACKGROUND AND PRIOR ART

At the United States Department of Energy's Hanford Site in Eastern Washington State, radioactive material is stored in hundreds of underground storage tanks. Since 2001 Sluicer Tank Cannons developed and manufactured by AGI Engineering, have been used to break up and retrieve the material located in these tanks.

The Sluicer technology used at Hanford represents continued development from previous Sluicing systems AGI developed to clean crude oil and chemical tanks. These systems utilize a fluid jet from a nozzle to impact, break up, and liquefy in-tank material so it can be pumped out of the tank.

Building on this technology, AGI developed and manufactured the first Extended Reach Sluicer System (ERSS) in the summer of 2010. This new system placed the Sluicer nozzle on an arm capable of extending up to 30 feet or more, positioning the nozzle closer to the material in the tank in order to provide increased cleaning efficiency. Subsequent upgrades included the addition of high pressure, low flow nozzles to improve cleaning efficiency.

As with earlier generations of Sluicers the Extended Reach Sluicer System made extensive use of polymers and elastomers on the in-tank portion of the system. In order to survive the harsh radioactive and chemical environment specific polymers and elastomers (rubber and thermoplastic hoses and seals) were used to meet specific requirements.

Previously, polymers and elastomers have been used in three subsystems within the tank. First are the process hoses and seals that transmit water and recycled liquefier to the high and low pressure wash nozzles. Second are the hoses and seals within the hydraulic system that are used to operate the boom extension and retraction functions, as well as the nozzle elevation and transverse movement. The third set of polymer/elastomer components within the tank are the wear pads and rollers that control the movement of the telescopic boom tubes as well as the hoses within the unit.

However, polymer and elastomer components have a limited life on in-tank portions of the Sluicer equipment due to being subject to the radioactive environment, extreme chemical environments and wide temperature ranges. This technology can also be used to clean tanks filled with other combinations of chemical, radioactive, hazardous and/or other materials, however the limited life of the polymer and elastomer components restricts the use of these devices.

Thus, the need exists for solutions to the above problems with the prior art.

SUMMARY OF THE INVENTION

A primary objective of the present invention is to provide extended reach sluicer systems, devices, and methods for breaking up and retrieving material from storage tanks with mechanical arms and nozzles which utilize fluid jets to break up and liquefy in-tank material.

A secondary objective of the present invention is to provide extended reach sluicer systems, devices, and methods for breaking up and retrieving material from storage tanks with mechanical arms and nozzles built with significantly reduced or eliminated use of polymer or elastomer components, to produce a more robust design, with a significantly extended life, to better accommodate tanks with considerably higher radiation levels, more extreme chemical environments and/or wider temperature ranges.

The design of the Mechanical Extended Reach Sluicer either moves in-tank polymer and elastomer components to outside of the tank, replaces them with metallic alternatives or shields/protects them making them suitable for the radioactive and chemical environment.

On the Mechanical Extended Reach Sluicer, a flexible metal conduit or convoluted metal hose is used to route wash water and liquefier through the pivoting elbow and to the nozzles with a single combination hose reel or two individual hose reels to take up the hose as the boom extends and retracts. Alternatively, telescopic sections of metal tubing or conduit can be used to take up all or a portion of the Boom Extend and Retract movement, eliminating the need for the hose reel(s).

When using telescopic sections the sealing elements between each section are made of a material and located in a housing with sufficient thickness and minimal clearance and/or secondary shielding/sealing at the joints so as to provide sufficient shielding and protection for the sealing element from the radioactive or chemical environment.

The hydraulic actuators that operate the boom extension/retraction, nozzle elevation and nozzle transverse movement are located at the top of the unit, outside the tank, where traditional materials can be used in a less aggressive radiological and chemical environment. These actuators connect to the operating portion of the equipment via metal cables, allowing each function to move in one direction with one cable and the other direction via a second cable, opposing spring tension, gravity, or other returning mechanism. Alternatively, a push-pull cable mechanism (such as a cable in a sheath) can be used to handle operation in both directions from a single cable.

The nozzle assembly is connected to the boom with a flexible metal conduit or section of convoluted hose, reinforced with pivoting segments. This allows for range of motion in both the up and down (elevation) and side to side (transverse) directions, but allows the pivots to carry the weight of the assembly and liquefier. Attached to these pivoting segments are the cables for pulling the nozzle assembly side to side and up and down. These cables flex the conduit or hose in order to direct the wash fluid from the nozzles.

Alternatively, the vertical and horizontal nozzle movement can be operated via two independent pivoting/rotating axes. Each of these axes can be operated via the cables routed through the take up mechanism. The cables, terminating at linkages or drums, cause the rotation of each axis. Product and High Pressure Wash fluids can be transmitted to the nozzles via flexible metal conduit or convoluted metal hose or via rotary swivel joints with each axis.

When using swivel joints for Nozzle Elevation and Nozzle Transverse axes, the swivel joint sealing element is made of a material and located in a housing with sufficient thickness and minimal clearance and/or secondary shielding/sealing at the joints so as to provide sufficient shielding and protection for the sealing element from the radioactive or chemical environment.

Depending on the chemical/radiological environment of each application, the wear pads and hose guide rollers on the Mechanical Extended Reach Sluicer can also be made of metal in order to provide increased longevity in harsh environments. In some applications it will also be beneficial to replace the boom wear pads with rollers to carry the load with reduced friction.

Further objects and advantages of this invention will be apparent from the following detailed description of the presently preferred embodiments which are illustrated schematically in the accompanying drawings.

BRIEF DESCRIPTION OF THE FIGURES

FIG. 7A is another top view of the extended boom with mast of FIG. 6B.

FIG. 7B is an enlarged cross-sectional view of the take up assembly of FIG. 7A along arrows 7B.

DESCRIPTION OF THE PREFERRED EMBODIMENTS

Figures 1A, 1B, 1C:
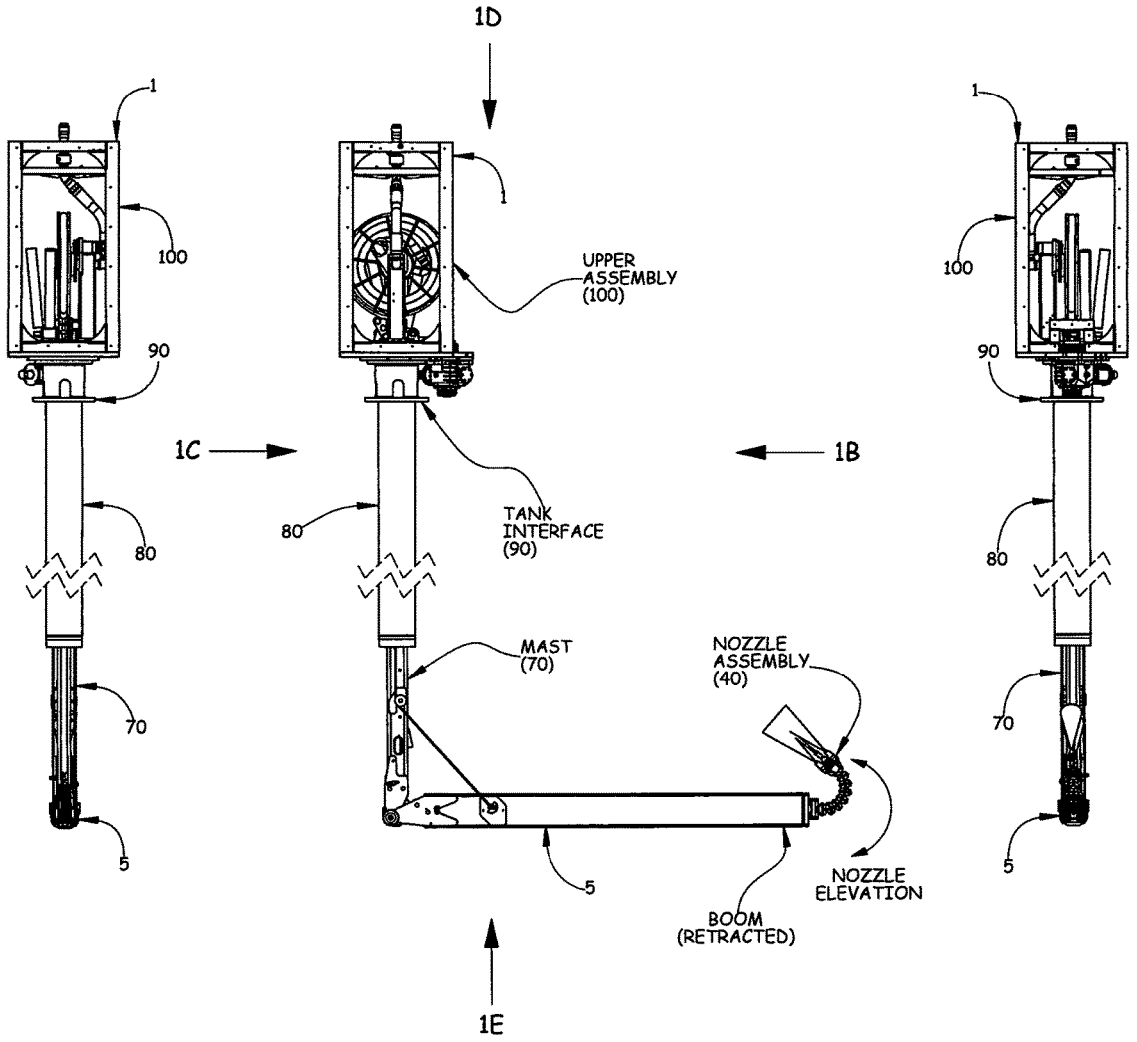
FIG. 1A is a left side view of the mechanical extended reach sluicer with the boom in a retracted position pivoted relative to the mast.
FIG. 1B is a front view of the retracted boom with mast of FIG. 1A along arrow 1B.
FIG. 1C is a rear view of the retracted boom with mast of FIG. 1A along arrow 1C.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary Above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A LIST OF COMPONENTS IS SHOWN BELOW

1 mechanical extended reach sluicer
5 boom/arm/boom assemblies
10 fixed boom stage
12 extend cable
14 forward extend pulley
16 direct retract cable
20 first boom stage
22 extend interconnect cable
24 extend idler pulley
26 retract idler pulley
28 interconnect retract pulley

Figure 1F:
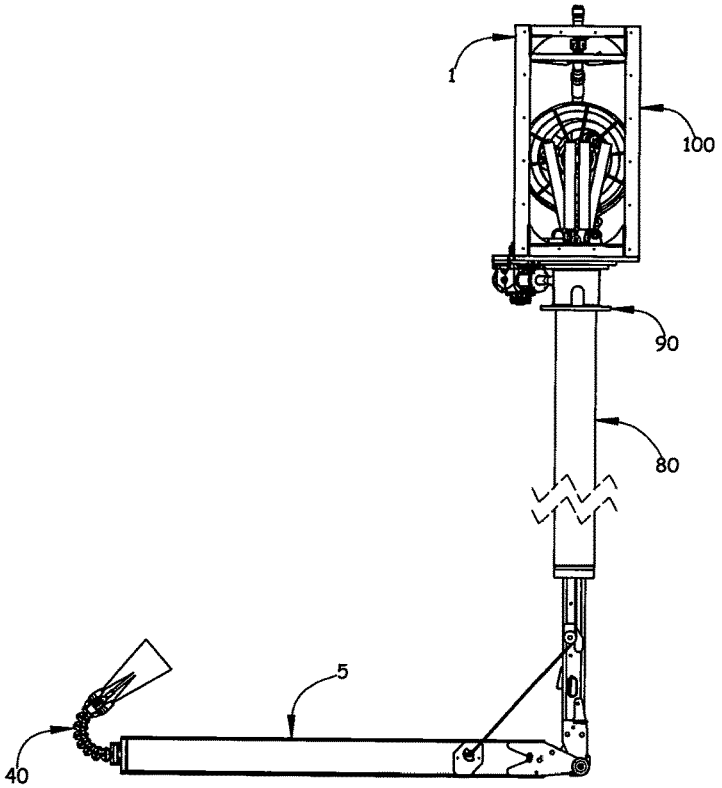
FIG. 1F is a right side view of the retracted boom with mast of FIG. 1A.
Figure 1D:
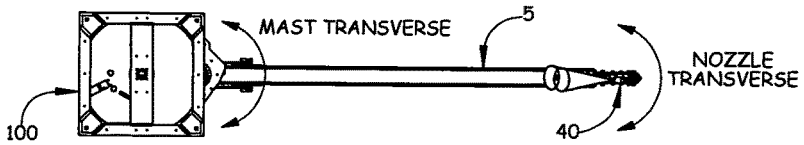
FIG. 1D is a top view of the retracted boom with mast of FIG. 1A along arrow 1D.
Figure 1E:
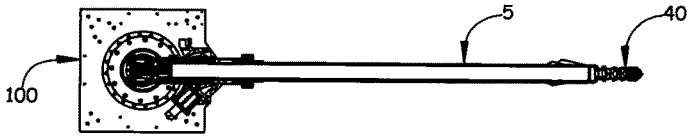
FIG. 1E is a bottom view of the boom with mast of FIG. 1A along arrow 1E.

30 second boom stage
32 take-up pulley
34 fixed rack gear
35 travelling pinion
36 traveling rack gear
38 forward pulley
40 nozzle assembly
41 nozzle elevation up control cable
42 nozzle elevation down control cable
43 nozzle elevation right control cable
44 nozzle elevation left control cable
45 hinge segment(s)
46 vertical hinge(s)
48 horizontal hinge(s)
52 product hose conduit
53 nozzle transverse rotary swivel joint
54 high pressure water hose/conduit
55 swivel joint sealing elements
56 high pressure low flow nozzles
57 swivel union cable
58 low pressure high flow nozzle
60 boom elevation
61 cable guide pulley(s)
62 boom elevation cable(s)
62 boom elevation pivot
63 boom elevation pulley(s)
64 control cables
66 elbow cables
70 mast
80 mast support
90 tank interface
100 upper assembly
105 slew ring gear
110 mast transverse motor
115 mast transverse gearbox
120 mast transverse pinion
125 turntable
130 boom elevation actuator
135 boom extend/retract actuators
140 hose reel
145 convoluted metal product hose
150 convoluted metal high pressure water hose
160 nozzle control cylinders
200 storage tank
210 retrieval pump
220 tank opening
230 cable guide pulleys
240 nozzle up/down rotary swivel joint
250 nozzle left/right rotary swivel joint FIG. 1A is a left side view of the mechanical extended reach sluicer 1 with the boom 5 in a retracted position pivoted relative to the mast 70. FIG. 1B is a front view of the retracted boom 5 with mast 70 of FIG. 1A along arrow 1B. FIG. 1C is a rear view of the retracted boom 5 with mast 70 of FIG. 1A along arrow 1C. FIG. 1D is a top view of the retracted boom 5 with mast 70 of FIG. 1A along arrow 1D. FIG. 1E is a bottom view of the boom 5 with mast 70 of FIG. 1A along arrow 1E. FIG. 1F is a right side view of the retracted boom 5 with mast 70 of FIG. 1A.

Figure 8:
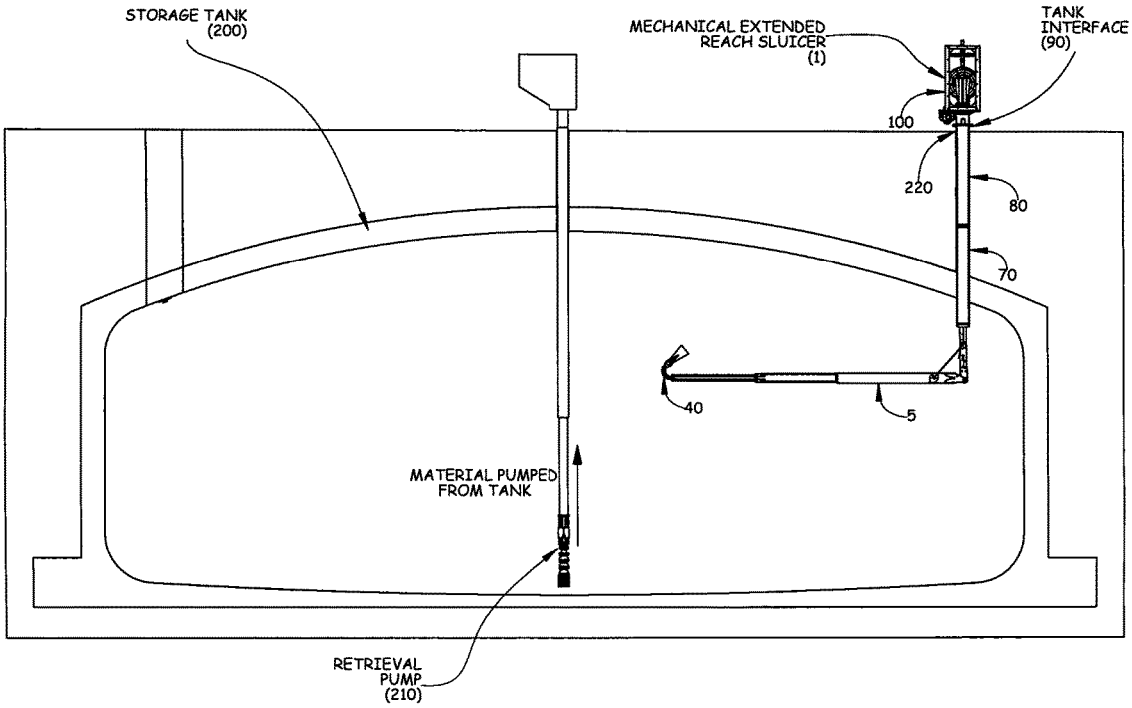
FIG. 8 shows a cross-sectional view of a storage tank with an installed mechanical extended reach sluicer and a retrieval pump.
Figure 9A:
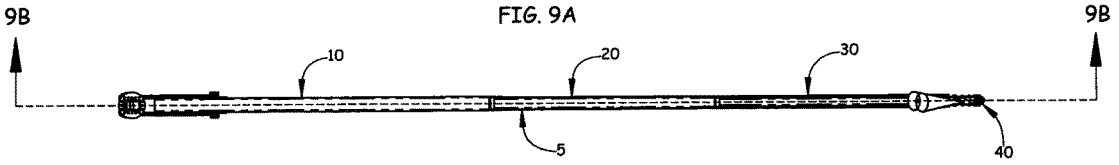
FIG. 9A is another top view of the extended boom with mast of FIG. 7A.
Figure 9B:
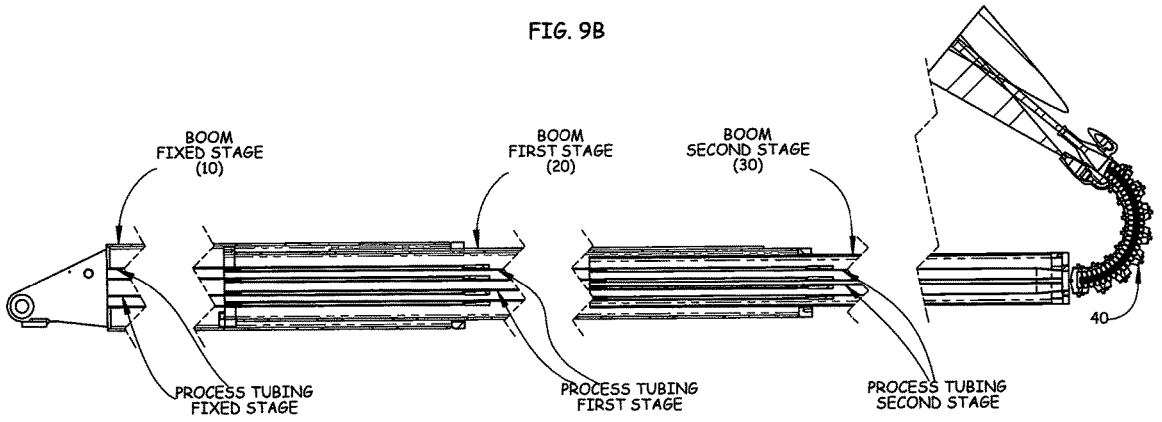
FIG. 9B is an enlarged cross-sectional view of the telescopic product and high pressure wash conduits of FIG. 9A along arrows 9B.

FIG. 8 shows a cross-sectional view of a storage tank 200 with an installed mechanical extended reach sluicer 1 and a retrieval pump 210.

Figure 3A:
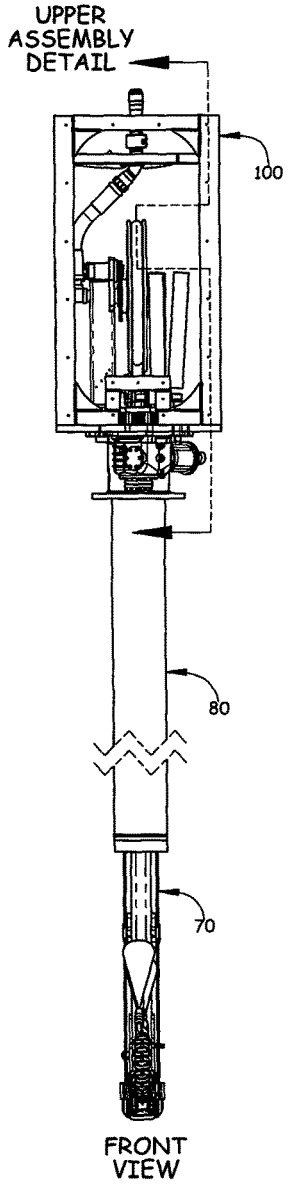
FIG. 3A is another front view of the retracted boom with mast of FIG. 1B.

Referring to FIGS. 1A-1F and 8, the upper assembly 100 houses all of the actuators (cylinders, winches, or the like) for each function, as well as the hose reel 140 which will be shown and described later in reference to FIGS. 3A-3B. This assembly 100 mounts to the outside of the tank (shown in FIG. 8), at the tank interface 90. At the tank interface 90 the tank will have a permanently or temporarily installed mounting face, flange or surface. The device will have a mating attachment face flange or surface that matches that on the tank. The device can be secured in place on the mounting face, flange or surface via permanent or temporary fastening means (mechanical fasteners, clamps, bolts, pins, adhesives, grout, etc.) or via gravity under its own weight or with added ballast.

The upper assembly houses the actuators (cylinders, winches, or the like) at a location outside of the tank 200 in order to protect the polymers and elastomers in these actuators (cylinders, winches, or the like) 130, 135, 160 from the harsh chemical and radioactive environment within the tank.

The upper assembly 100 connects to a mast support 80 and a mast 70 which runs vertically down through the tank opening 220, providing a means to mount the boom 5, as well as providing structural support and a passage for the product and high pressure wash hoses/conduits, and the control cables.

The boom 5 extends and retracts as well as pivots up and down, in order to position the nozzle assembly 40 closer to the material at the bottom of the tank 200. Similar to the mast 70, the boom 5 also provides structural support and a passage for the product and high pressure wash hoses/conduits 145, 150, and the control cables 12, 22, 16, 28, 41, 42, 43, 44 required to operate the nozzle assembly 40 (to be described later in reference to FIGS. 6D, 6E, 6F, 7B, and 9B) to reach the nozzle assembly 40.

The nozzle assembly 40 (shown and described later in FIG. 5B) includes low pressure, high flow and high pressure, low flow nozzles in order to break up and liquefy material.

A. Degrees of Freedom

The mechanical extended reach sluicer 1 includes five basic degrees of freedom. The mast transverse (FIGS. 1D, 6B) rotates the mast 70 and boom assemblies 5 clockwise and counterclockwise. The boom elevation (FIGS. 2A, 2B) raises and lowers the boom (arm) 5. The boom extend (FIGS. 6A, 6B, 7A and 7B) and retract (FIGS. 6A, 6B, 7A and 7B) adjusts the overall length of the boom 5. The nozzle elevation (FIGS. 1A, 5A, 5B) raises and lowers the nozzle assembly 100 (FIGS. 5A-5B) and the nozzle transverse (FIGS. 1D, 6B) directs the nozzle assembly 100 (FIGS. 5A-5B) left and right.

B. Mast Transverse

The mast transverse drive (see upper assembly 100 FIGS. 1A-1F, 3A-3B) is comprised of a slew ring gear 105 (or a gear and turntable bearing) located in the upper assembly 100, driven by the mast transverse motor 110 through the mast transverse gearbox 115 and the mast transverse pinion 120, spinning the turntable 125 clockwise or counterclockwise. The mast 70 and leg 80 can be attached to the turntable 125, and the boom 5 to the mast 70, so as the Turntable rotates so does the Mast and Boom.

C. Boom Elevation

Figure 2B:
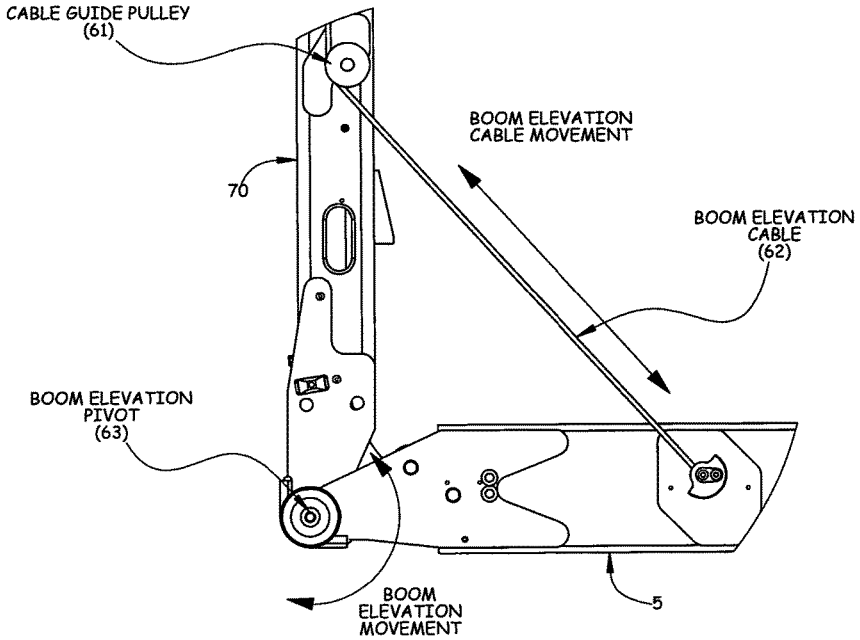
FIG. 2B is an enlarged view of the boom elevation detail of FIG. 2A where the boom pivots relative to the mast.
Figure 2A:
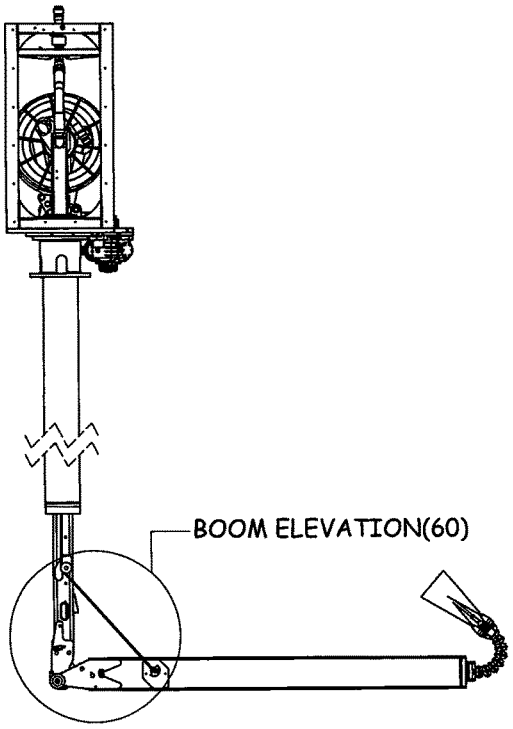
FIG. 2A is another left side view of the retracted boom with mast of FIG. 1A.

The boom elevation 60 operation is illustrated on the boom elevation detail view (FIGS. 2A-2B). Boom elevation actuators 130 (cylinders, winches, or the like) located in the upper assembly 100, outside the tank 200 (FIG. 8), actuate the boom 5 elevation via cables 62. Shown in FIG. 2B is one of two cables mounted to either side of the mast 70 and boom 5. Alternatively a single cable or more than 2 cables can be used with various other attachment points on the boom or other pulley and cable routing through the mast. The boom elevation cable(s) are routed through the mast 70, guided via cable guide pulley(s) 61, and fastened to the boom 5. Retracting these cable(s) 62 causes the boom 5 to be raised relative to mast 70 via boom elevation pivot 63, and extending these cable(s) 62 causes the boom 5 to be lowered relative to the mast 70 via boom elevation pivot 63.

Figure 3B:
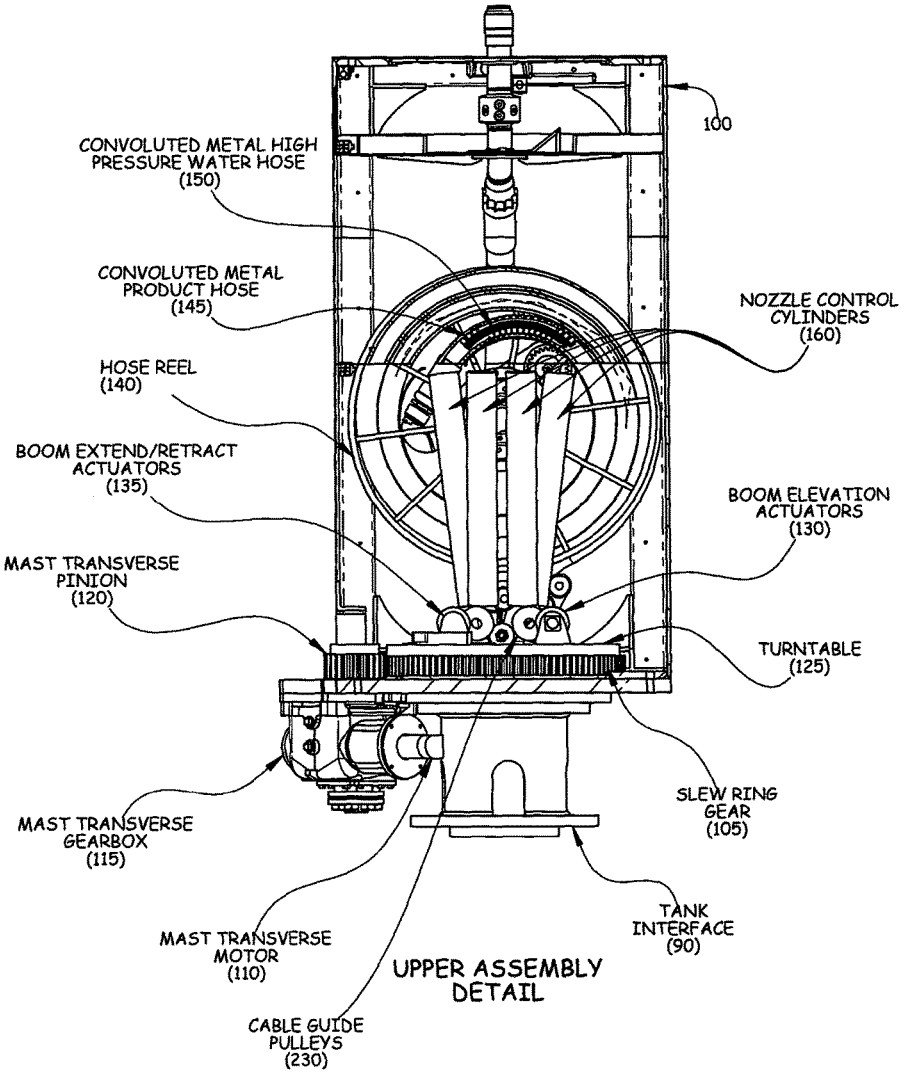
FIG. 3B is an enlarged view of the upper assembly detail of FIG. 3A.

The opposite end of the boom elevation cable(s) is connected to the boom actuator, shown as a winch in FIG. 3B. As the cable is spooled and unspooled on the winch the boom is raised and lowered. Alternatively the boom actuator can be a hydraulic cylinder, linear actuator, or other device that takes up the cable to raise the boom and pays out the cable to lower the boom.

D. Boom Extend & Retract

Figure 4A:
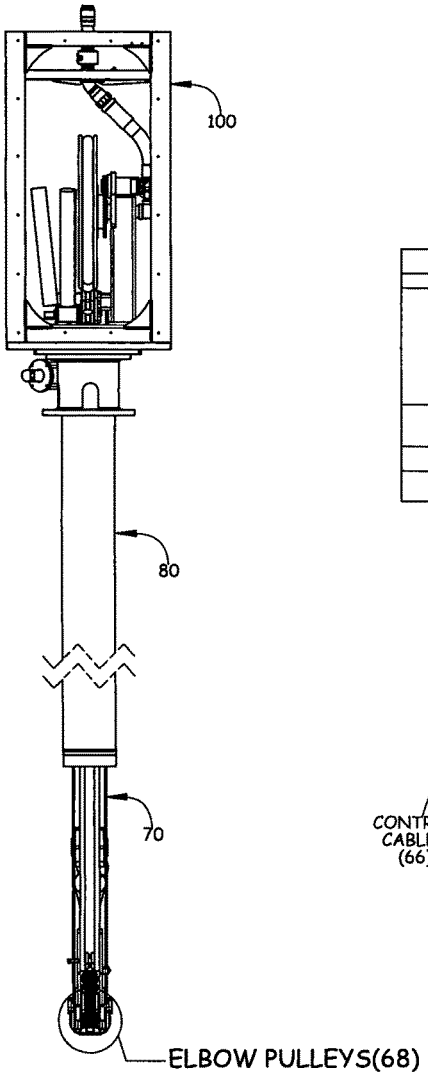
FIG. 4A is another rear view of the retracted boom with mast of FIG. 1C.
Figure 4B:
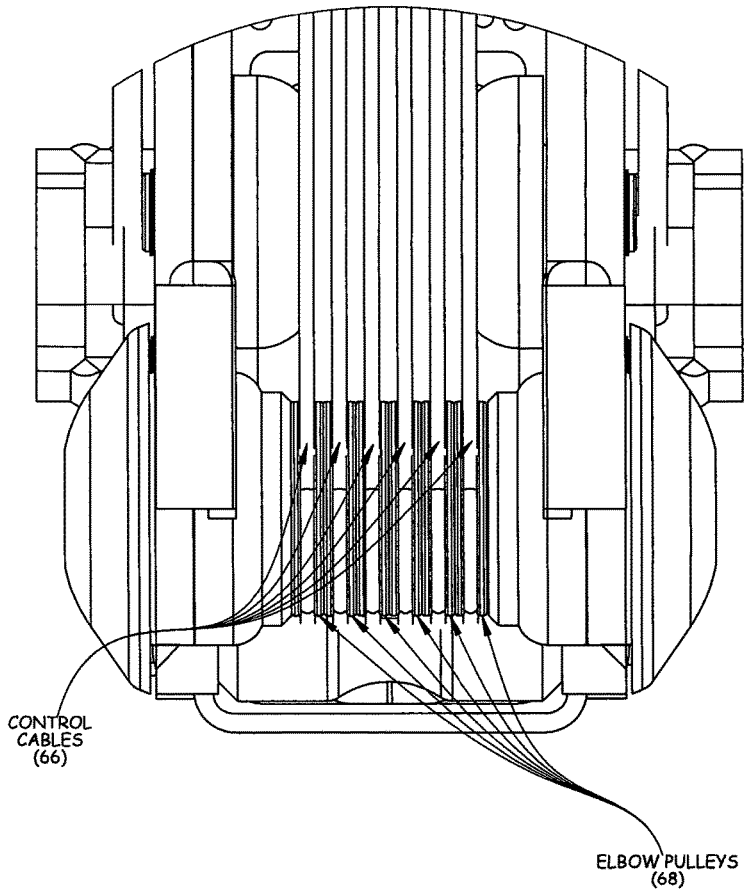
FIG. 4B is an enlarged view of the elbow pulleys on the mast bottom of FIG. 4A.

The boom extend and retract functions (FIGS. 6A, 6B, 6C, 6D, 6E, 6F, 7A and 7B) are operated by cables connected to the boom extend and retract actuators 135 (cylinders, winches, or the like) located in the upper assembly 100 shown in FIG. 3B, outside the tank 200 FIG. 8. These cables 66 are guided down the mast via cable guide pulleys 230 and around the elbow pulleys 68 (FIGS. 4A-4B). One of the actuators (cylinders, winches, or the like) 135 (FIG. 8) and one of the control cables 66 is used to extend the boom 5 and another of the actuators (cylinders, winches, or the like) 135 and another of the control cables 66 is used to retract the boom 5, or a single actuator can be used for retracting and extending.

FIGS. 6A-6F shows the boom 5 with fixed boom stage 10, and telescoping first boom stage 20 and telescoping second boom stage 30, which can be telescoping tubular sections.

The extend cable 12 runs down the length of the boom fixed stage 10 (Fixed Stage) and wraps around the forward extend pulley 14 at the end of the Fixed Stage 10. The cable 12 is routed to the rear of the boom first stage 10 (First Stage) where it is attached, retracting this cable 12 causes the First Stage 10 to be extended forward.

An extend Interconnect cable 22 can be routed from a mounting point at the forward end of the Fixed Stage 10 around the extend idler pulley 24 on the forward end of the First Stage 20, and attached to a mounting point at the rear of the boom second stage 30 (Second Stage). When the First Stage 20 is extended via retracting the extension cable, the extend interconnect cable 22 causes the Second Stage 30 to be extended in time with the first. Both boom telescopic stages 20, 30 extend simultaneously together.

A retract cable 16 can be connected to either the First Stage 20 or the Second Stage 30. A direct retract cable 16 can be connected to the Second Stage 30, retracting both Stages 20, 30 directly, but will require twice as much cable movement as the extend cable 12.

Using the interconnected retract cable configuration, the retract cable 16 is connected to the First Stage 20, which is retracted directly. A retract interconnect cable 28 is needed, similar to the extend configuration, to retract the Second Stage 30.

One end of the retract interconnect cable 26 is connected to a mounting point at the rear of the Second Stage 30 and routed around the retract idler pulley 26 at the rear of the First Stage 20 to a mounting point at the forward end of the Fixed Stage 10. When the First Stage 20 is retracted the movement of the retract idler pulley 26 in relation to the retract interconnect cable 28 mounting point on the Fixed Stage 10 causes the Second Stage 30 to be retracted as well.

With the interconnected retract cable configuration the retract cable 16 moves the same amount as the extend cable 12 and the Second Stage 30 will retract in time with the boom First Stage 20. Both boom telescopic stages 20, 30 will retract simultaneously together.

E. Pinion/Pulley Cable Take-Up

In order to allow control of the nozzle elevation and transverse functions without disruption from the boom extend and retract functions, a method of taking up and maintaining tension on the cables actuating the nozzle functions is required.

The method used for this take-up, on each of the four nozzle control cables 41, 42, 43 and 44 (see FIGS. 5B and 7A, 7B and 7C), is to use a travelling take-up pulley 32 synchronized to maintain tension on each cable 41, 42, 43 and 44.

Each nozzle control cable 41, 42, 43 and 44 can be routed from the elbow pulley(s) 68 (FIG. 4B) to a forward pulley 38 at the forward end of the Boom Fixed Stage 10 and back to the take-up pulley 32 along the Fixed Stage 10 and then around to the nozzle assembly 100.

The movement of the take-up pulley 32 can be synchronized so that even though the length of the boom 5 is extended or retracted the cable length between the forward pulley 38 at the forward end of the Fixed Stage 10 and the Nozzle Assembly 100 stays constant. This allows the nozzle control cables 41, 42, 43 and 44 to hold or actuate the Nozzle Assembly 100 by holding the cables 41, 42, 43, 44 or making small cable movements, regardless of whether the boom is stationary, retracting or extending.

As the nozzle control cables 41, 42, 43 and 44 are doubled over the take-up pulley 32 the take-up pulley 32 only moves half of the distance the Nozzle Assembly 100 moves in order to take up the cable slack, as one length of pulley travel in nozzle control cables 41, 42, 43 and 44 is taken up on each side of the take-up pulley 32.

The synchronized movement of the pulley with the boom extend and retract movement is accomplished by mounting the take-up pulley 32 on a traveling pinion gear 35, between two rack gears 34, 36 is attached to the boom Fixed Stage 10, while the traveling rack gear 36 is mounted to the Nozzle Assembly 100. The pinion 35 "floats," trapped between the traveling rack gear 36 and the fixed rack gear 34, and the pulley 32 travels with the pinion 35, however is free to spin independently about the same axis as the pinion 35. In one embodiment the pinion 35 can be integrated around the pulley 32 (FIG. 7C) and the cable(s) 41-44 runs through a groove in the rack gear 36.

The pinion/pulley 32/35 (FIGS. 7A-7B) starts at the rear of the fixed rack gear 34 and forward of the traveling rack gear 36. As the boom 5 extends, the traveling rack gear 36 is pulled forward by the Nozzle Assembly 100, the traveling pinion 35 rolls forward between the traveling rack gear 36 and fixed rack gears 34 at half the speed of the traveling rack gear 36. At any given time the pinion/pulley 35, 32 has moved half as far as the traveling rack gear 36, maintaining the tension on the cable(s) 41, 42, 43 and 44.

This rack and pinion arrangement is repeated for each of the cables 41, 42, 43 and 44 required to operate the Nozzle Assembly 100.

F. Nozzle Elevation and Transverse

Figure 5B:
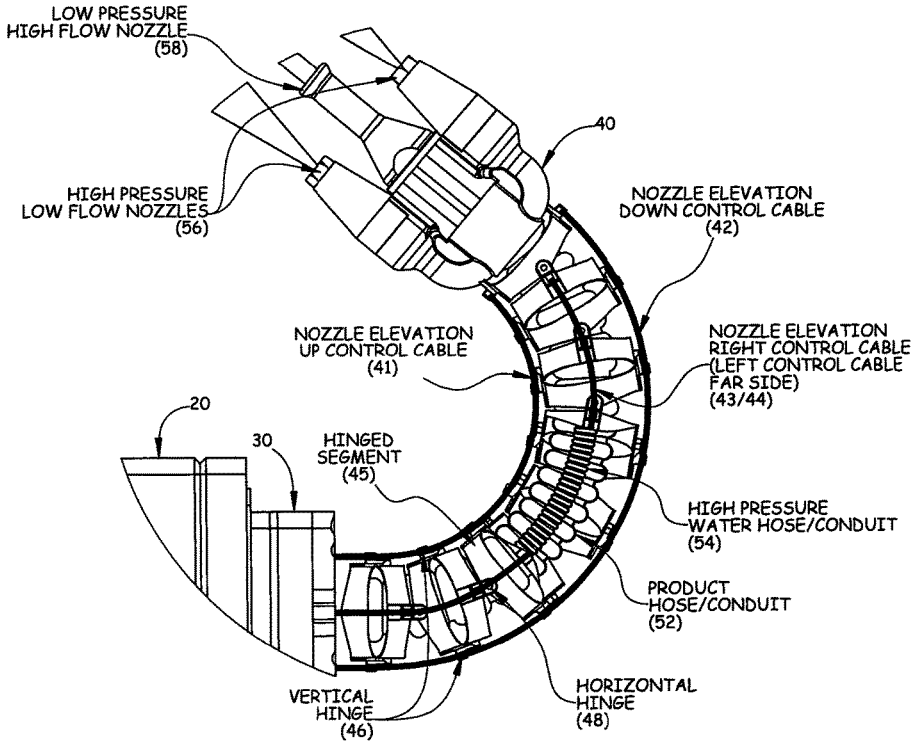
FIG. 5B is an enlarged view of the nozzle assembly of FIG. 5A.
Figure 5A:
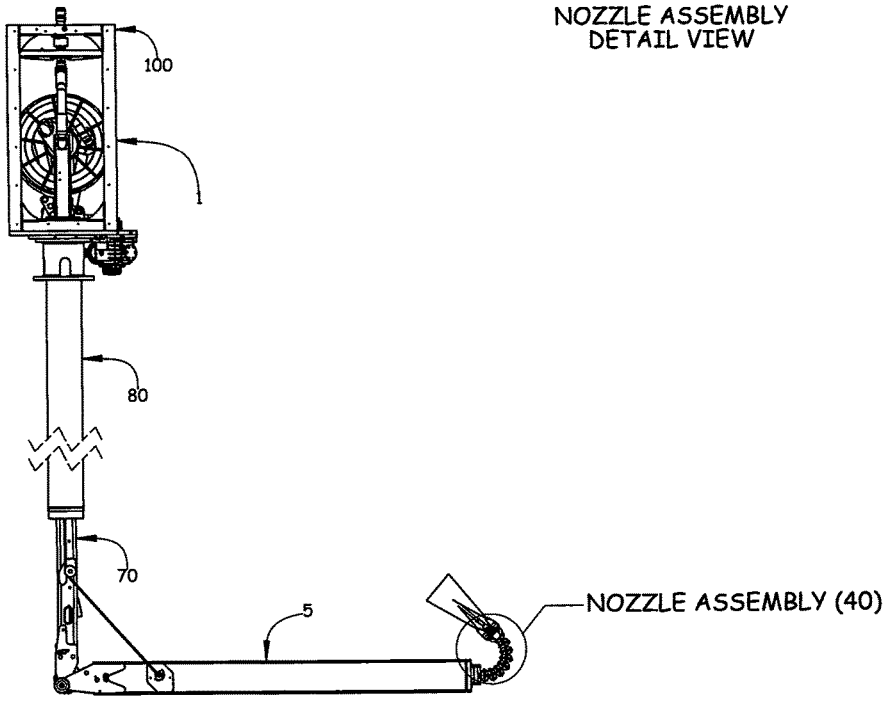
FIG. 5A is another left side view of the retracted boom with mast of FIG. 1A.
Figure 6B:
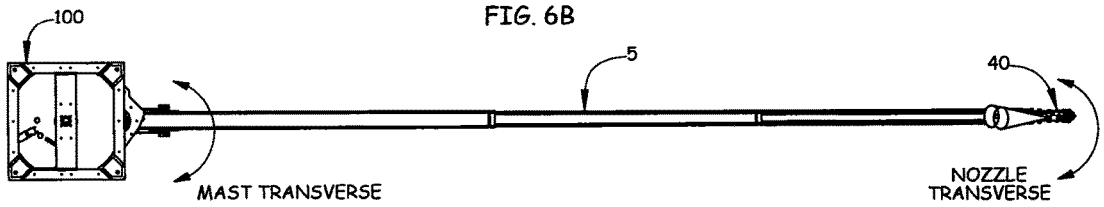
FIG. 6B is a top view of the extended boom pivoted to mast of FIG. 6A.
Figure 6A:
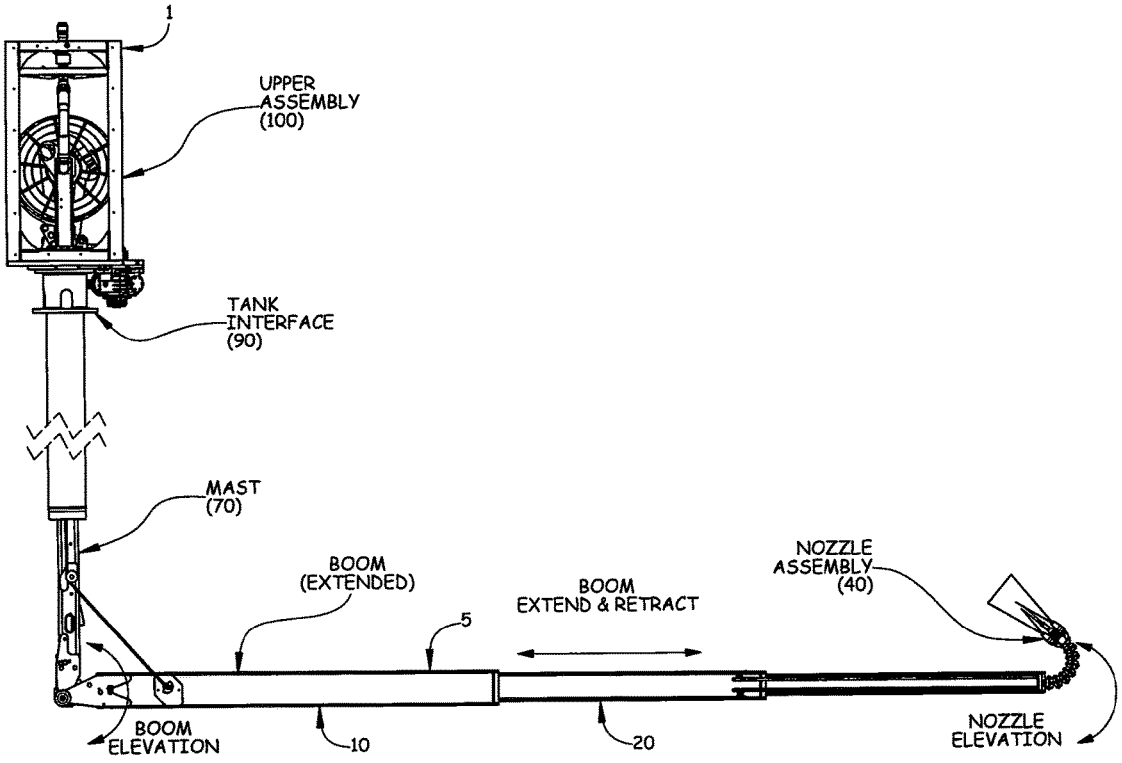
FIG. 6A is another left side view of the boom in an extended position pivoted relative to the mast.
Figure 6C:
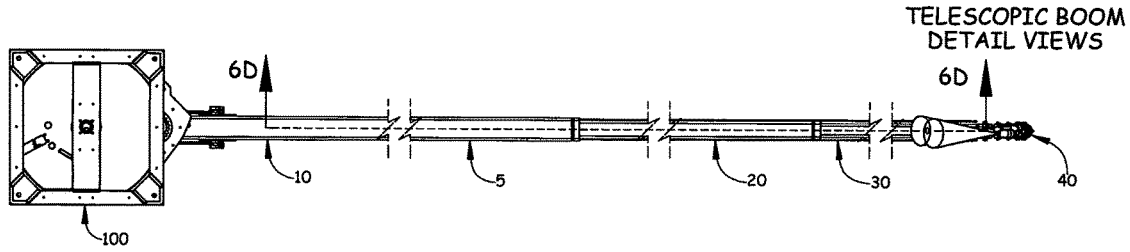
FIG. 6C is another top view of the extended boom with mast of FIG. 6A.
Figure 6D:
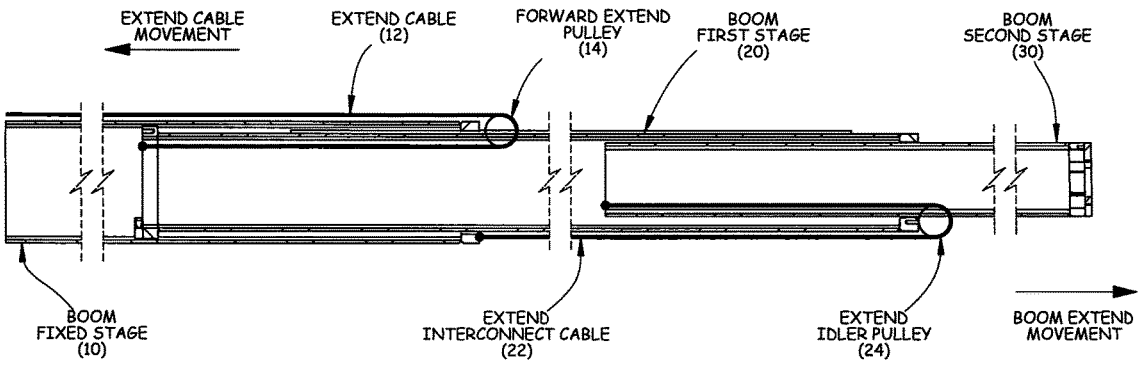
FIG. 6D is a cross-sectional view of extended boom of FIG. 6C along arrows 6D, showing the extend cables.
Figure 6E:
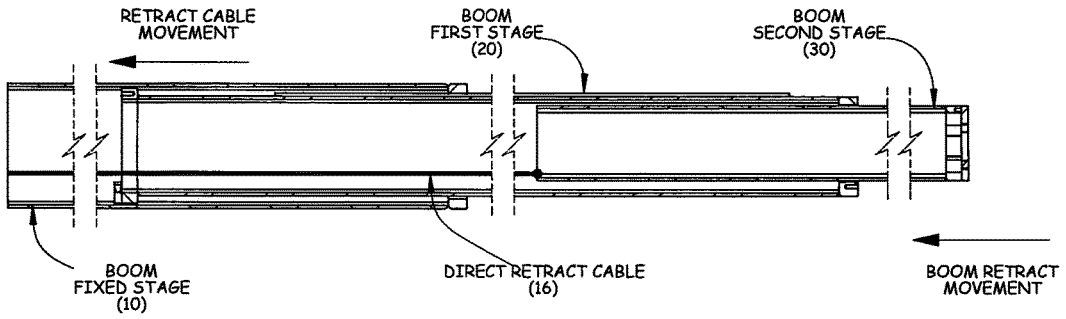
FIG. 6E is another cross-sectional view of the extended boom of FIG. 6C showing the direct retract cable.
Figure 6F:
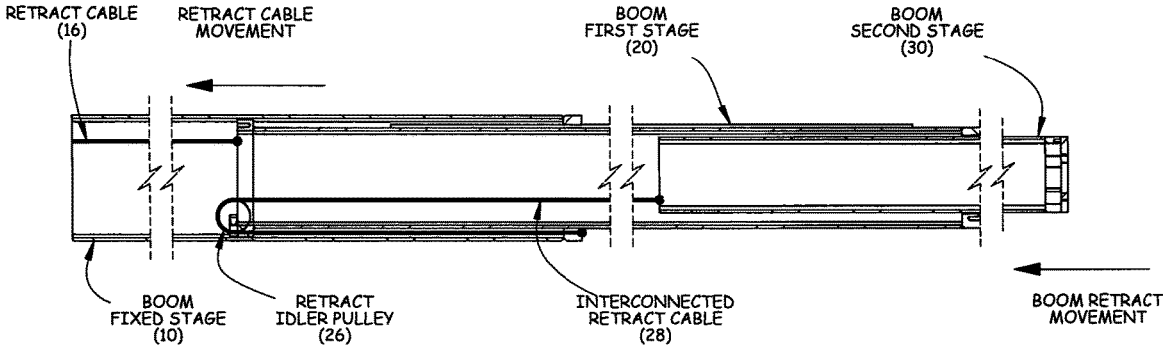
FIG. 6F is another cross-sectional view of the extended boom of FIG. 6C showing the interconnected retract cable.
Figure 7C:
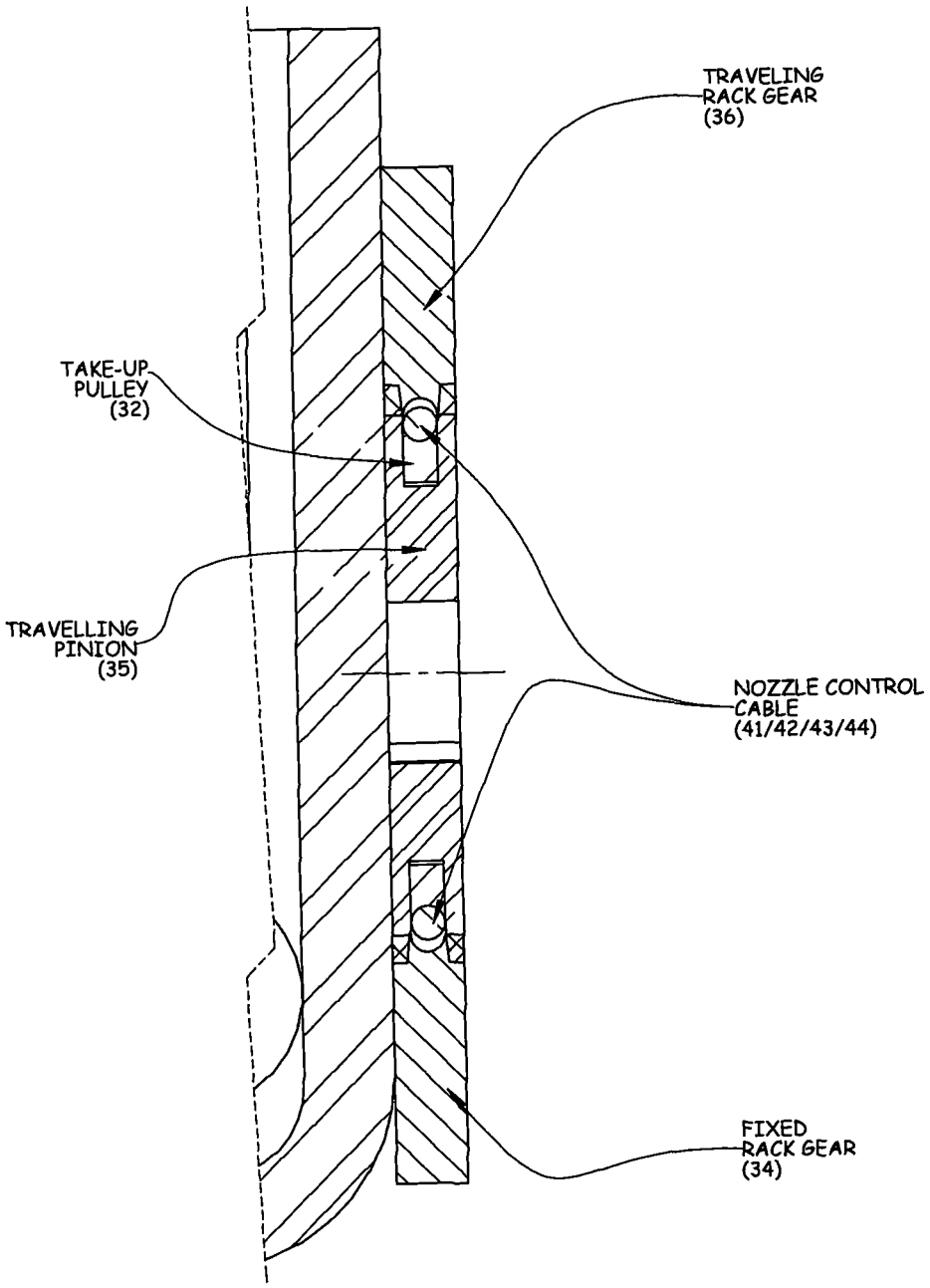
FIG. 7C is an enlarged cross-sectional view of the take up assembly of FIG. 7B along arrows 7C.
Figure 10A:
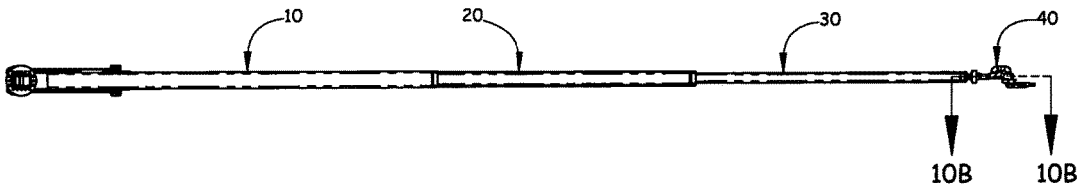
FIG. 10A is another top view of the extended boom with mast of FIG. 9A.
Figure 10B:
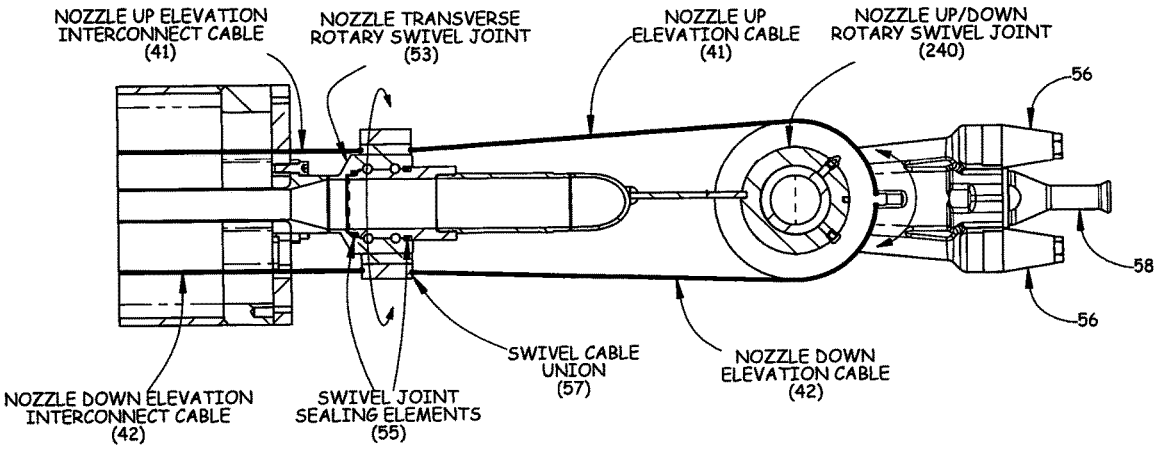
FIG. 10B is an enlarged cross-sectional view of the pivoting nozzle assembly of FIG. 10A along arrows 10B.

Referring to FIGS. 5B and 10B, the Nozzle Assembly 100 flexes via a section of flexible metal conduit or convoluted metal hose 52, which may be the opposite end of the convoluted metal product hose 145, FIG. 3B, or a separate section of hose with a joint, connection, or rigid section of pipe, tubing, or the like, between them.

The wash water and liquefier is transmitted to the Nozzle Assembly 100 (FIGS. 5A-5B) via this flexible metal conduit or convoluted metal hose 52. Around this flexible metal conduit or convoluted metal hose 52 are round, hollow, tubular or the like segments 45 joined by hinges.

The hinges on the segments 45 alternate, with every other hinge arranged to pivot about the vertical axis and the others arranged to pivot about the horizontal axis. Each hinge allows a limited range of motion, thereby limiting the amount of bending the flexible metal conduit or convoluted metal hose 52 can be subject to in that local area, preventing the flexible metal conduit or convoluted metal hose 52 from kinking or buckling.

Because half the hinged segments 45 are arranged to bend around a horizontal hinge 48 they allow the flexible metal conduit or convoluted metal hose 52 to bend up and down in small amounts for each hinged segments 45. With a sufficient number of segments linked together the total amount of movement at the nozzles 56 and 58 can be large, while still preventing the flexible metal conduit or convoluted metal hose 52 from buckling or kinking. The vertically hinges 46 operate in the same manner, except restricting movement about a vertical axis, allowing the flexible metal conduit or convoluted metal hose 52 to flex left and right, while at the same time controlling buckling or kinking.

Four nozzle control cables 41, 42, 43 and 44 (for up, down, left, and right motion) can be thread through holes at each quadrant of the hinged segments 45 and fixed at the Nozzle Assembly 100. Pulling on one of these cables 41-44 pulls the Nozzle Assembly 100 toward that direction, flexing the flexible metal conduit or convoluted metal hose 52 along the path restricted by the hinged segments.

The four nozzle control cables 41, 42, 43 and 44, one at each quadrant are operated via the nozzle control cylinders 160, actuators, or the like in the Upper Assembly 100 (FIG. 3B), and allow the hose 52 to be actuated up and down and/or left and right to direct and aim the nozzles 56, 58.

Figure 11A:
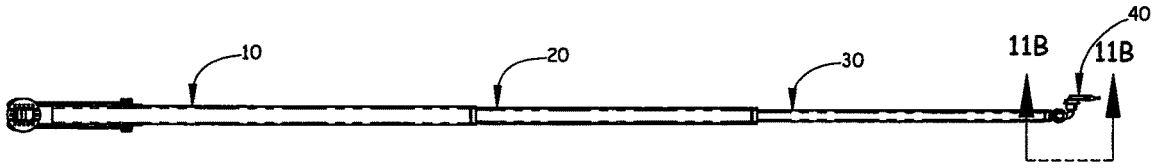
FIG. 11A is another top view of the extended boom with mast of FIG. 10A.
Figure 11B:
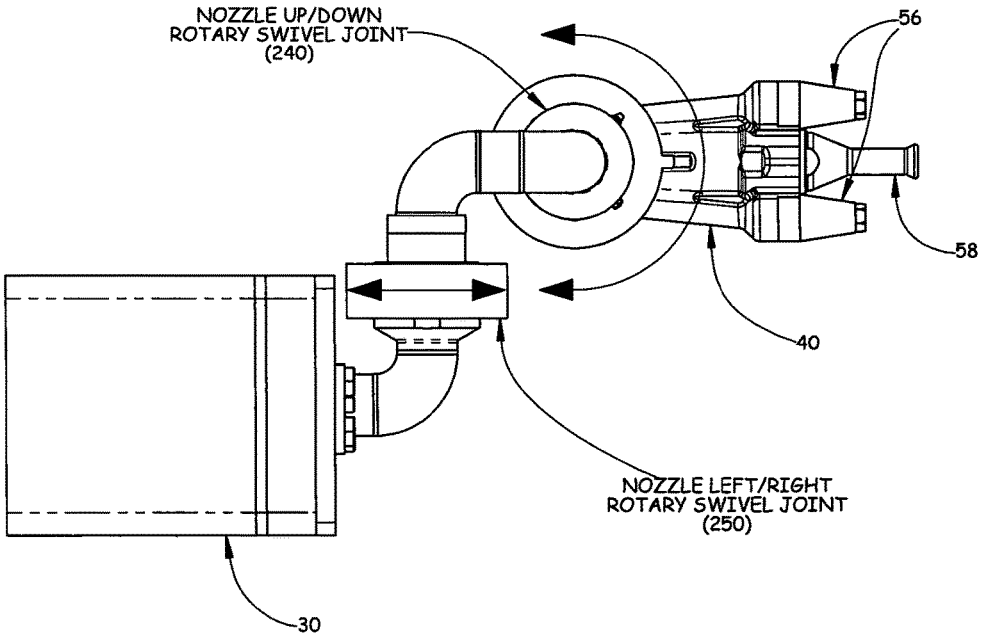
FIG. 11B is an enlarged view of the pivoting nozzle assembly of FIG. 11A along arrows 11B.

Alternatively, the horizontal and vertical nozzle movement can be operated via two independent pivoting/rotating axis (FIGS. 10B & 11B) with one (FIG. 10B) or both (FIG. 11B) of the axis of rotation being perpendicular to the axis of the boom. Each of these axes can be operated via the cables 41, 42 routed through the take up mechanism. The cables, terminating at linkages or drums with a fixed point on the mechanism some distance from the axis of rotation, allow the mechanism to be rotated by pulling on the cables. Product and high pressure wash fluids can be transmitted to the nozzles via flexible metal conduit or convoluted metal hose 52, 54 or via rotary swivel joints for each axis 57, 240, 250.

Swivel joints along each axis of motion transmit product and high pressure wash fluids across the interfaces between the stationary components on one side of the pivot and rotating components on the other. This is done via a close fit between the fixed and rotating components, with a polymer, elastomer, metallic, or composite sealing element 55 (o-ring, packing, or the like) filling the gap between the fixed and rotating components so as to eliminate or reduce leakage through that gap.

When using swivel joints the swivel joint sealing elements 55 are made of a material and located in a housing with sufficient thickness and minimal clearance and/or secondary shielding/sealing at the joints so as to provide sufficient shielding and protection for the sealing element from the radioactive or chemical environment.

G. Product & High Pressure Wash Hose/Conduit Take-Up

Referring to FIGS. 3B and 5B, the low pressure product hose/conduit can be made of a flexible metal conduit or convoluted metal hose and is routed down through the mast 70 and boom 5 to meet the Nozzle Assembly 100 at the forward end of the boom Second Stage 30. The product hose/conduit 52, 145 can be flexible to allow for bending at the boom elevation pivot 63 FIG. 2B, and to wrap around the Hose Reel 140 (FIGS. 3A-3B). In order to provide take-up when the boom 5 is retracted the product hose 145 is accumulated on a hose reel 140 in the Upper Assembly 100. As the boom 5 is retracted the excess hose is reeled onto the hose reel 140 and as the boom 5 is extended the hose is reeled off.

Referring to FIGS. 3B and 5B, the smaller, high pressure wash hose/conduit 54, 150, also made out of a flexible metal conduit or convoluted metal hose, can have its' own hose reel 140 or can be run through the center of the product hose/conduit 52, 145 in order to save space and simplify hose management. The hose reel 140 can have a second circuit allowing high pressure water to be fed through the hose reel 140 to the high pressure wash hose/conduit 54, 150. The high pressure wash hose/conduit 54, 150 can be retracted and accumulated on the hose reel 140 along with the product hose/conduit 52, 145.

Although this embodiment describes tanks with radioactive issues, the invention can be used for systems, devices, and methods for breaking up and retrieving chemical, hazardous and/or other waste and/or other materials, and the like, from storage tanks with mechanical arms and nozzles which utilize fluid jets to break up and liquefy tank material. The invention can work with tanks having additional issues such as having high temperature and/or low temperature conditions.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A sluicer system comprising:

an upper assembly attached to a tank;

a mast having an upper end attached to the upper assembly, and a lower end;

a boom having a first end pivotally attached to the lower end of the mast, and a second end, the boom having a retracted position and an extended position; and a nozzle assembly attached to the second end of the boom, wherein the nozzle assembly includes a flexible/convoluted metallic hose/conduit, and the boom is retractable to the retracted position and extendable to the extended position based on controls in the upper assembly.

* * * * *